US006875119B2

(12) United States Patent
Murphy et al.

(10) Patent No.: US 6,875,119 B2
(45) Date of Patent: Apr. 5, 2005

(54) DOUBLE ENTRANCE FOR USE IN AN INFLATABLE ENCLOSURE

(75) Inventors: John Kenneth Murphy, Stouffville (CA); Sylvia Ostroskie, Oshawa (CA)

(73) Assignee: Leisure Activities Unlimited, Newmarket (CA)

( * ) Notice: Subject to any disclaimer, the term of this patent is extended or adjusted under 35 U.S.C. 154(b) by 0 days.

(21) Appl. No.: 10/412,294

(22) Filed: Apr. 14, 2003

(65) Prior Publication Data

US 2004/0204255 A1 Oct. 14, 2004

(51) Int. Cl.[7] ..... A63G 31/12
(52) U.S. Cl. ..... 472/134; 52/2.13
(58) Field of Search ..... 472/134; 446/220, 446/224, 225; 482/35; 52/2.13, 2.14, 2.17, 2.21, 2.22, 2.25

(56) References Cited

U.S. PATENT DOCUMENTS

| | | | | | |
|---|---|---|---|---|---|
| 2,754,836 | A | * | 7/1956 | Darby | 52/2.21 |
| 3,159,165 | A | | 12/1964 | Cohen et al. | 135/1 |
| 3,250,024 | A | | 5/1966 | Douthitt et al. | 35/43 |
| 3,335,529 | A | | 8/1967 | Gedney | 52/2 |
| 3,769,763 | A | | 11/1973 | Kwake | 52/2 |
| 3,903,659 | A | | 9/1975 | Echtler | 52/2 |
| 4,103,369 | A | * | 8/1978 | Riordan | 52/2.14 |
| 4,164,829 | A | | 8/1979 | Sadler | 52/2.14 |
| 4,384,435 | A | * | 5/1983 | Polise et al. | 52/2.19 |
| 4,974,829 | A | | 12/1990 | Gamow et al. | 472/94 |
| 5,462,505 | A | * | 10/1995 | Blair et al. | 482/27 |
| 5,471,797 | A | * | 12/1995 | Murphy | 52/2.17 |
| 5,537,784 | A | * | 7/1996 | Baldwin | 52/2.17 |
| 5,603,185 | A | | 2/1997 | Murphy | 52/2.17 |
| 5,761,852 | A | * | 6/1998 | Liu | 52/2.18 |
| 5,772,535 | A | * | 6/1998 | Murphy | 473/415 |
| 5,893,238 | A | * | 4/1999 | Peacock et al. | 52/2.18 |
| 5,970,661 | A | * | 10/1999 | Bishop et al. | 52/2.11 |
| 6,029,404 | A | * | 2/2000 | Lewis | 52/2.18 |
| 6,119,408 | A | * | 9/2000 | Page | 52/2.23 |
| 6,192,633 | B1 | * | 2/2001 | Hilbert | 52/2.18 |
| 6,266,927 | B1 | * | 7/2001 | Leslie | 52/2.17 |
| 6,565,405 | B2 | * | 5/2003 | Hsu et al. | 446/89 |

FOREIGN PATENT DOCUMENTS

| | | |
|---|---|---|
| FR | 2101367 | 3/1972 |
| SU | 667649 | 6/1979 |

* cited by examiner

*Primary Examiner*—K. T. Nguyen
(74) *Attorney, Agent, or Firm*—Marcelo K. Sarkis; Neil H. Hughes; Ivor M. Hughes

(57) ABSTRACT

An inflatable enclosure comprising:

at least one inflating means for inflating said inflatable enclosure;

at least one entrance/exit means for entering and exiting said inflatable enclosure;

at least one air pressure regulator for maintaining the air pressure in said enclosure when said at least one entrance/exit means is in use, at least one inflatable rigidifying means;

wherein at least one of said entrance/exit means and air pressure regulator is air actuated.

24 Claims, 14 Drawing Sheets

DOUBLE ENTRANCE FOR USE IN AN INFLATABLE ENCLOSURE

FIELD OF INVENTION

The present invention relates to a double entrance for use in an inflatable enclosure for amusement purposes and/or promoting physical activity.

BACKGROUND OF THE INVENTION

In the prior art, there exists many Inflatable Structures. One such example is found in U.S. Pat. No. 3,159,165, which discloses an inflatable air-supported structure, having a door which may be made out of wood, fiberglass, or other rigid or semi-rigid material. Other examples which can be found are U.S. Pat. Nos. 3,250,024; 3,335,529; 3,769,763; 3,903,659; 4,103,369; 4,164,829; 4,974,829; French patent publication No. 2,101,367; and Soviet patent publication No. 667,649. Of the above, those references purporting to teach the use of an inflatable structure for amusement purposes are: U.S. Pat. Nos. 4,103,369; 4,164,829; and French patent publication No. 2,101,367.

Applicant's prior patents namely U.S. Pat. No. 5,471,797 and U.S. Pat. No. 5,603,185 include a single entrance. Applicant has found that the single entrance does not maintain the pressure in the inflatable enclosure adequately when a plurality of people enter the enclosure. Also, Applicant has found that some children are slower in entering the enclosure, and keep the doors open for an extended period of time which causes partial deflation of the inflatable enclosure.

Nowhere within the prior art, is there shown, as far as applicant is aware, an inflatable structure which has means to prevent substantial deflation of the inflatable enclosure when a person enters and/or exits it. By preventing substantial deflation of the enclosure when a person enters and/or exits the enclosure, the enclosure remains substantially inflated thus maintaining a comfort level for those entering the inflatable enclosure and those watching, for example, parents watching children when entering the enclosure.

SUMMARY OF THE INVENTION

Accordingly, it is an object of the present invention to provide an inflatable enclosure, for use as not only an amusement device for children, but also as a physical activity promoter as well.

Yet still another object of the invention is to provide an inflatable enclosure which has ventilation means to regulate the pressure and quality of air therein.

It is still another object of the invention to provide a method of amusing and promoting physical activity (i.e., cardiovascular, muscular, etc.), and teaching children hand-eye, foot-eye coordination, within an inflatable enclosure.

It is yet another object of the invention to provide an inflatable enclosure inflated by a blower or the like. A further object of the invention is to provide an inflatable enclosure which has an air actuated (air inflatable) entrance and exit area that minimizes pressure loss and air loss in the enclosure, when entering and/or exiting the enclosure, and preferably allows a person entrance into and exit from the inflatable enclosure without aid from another person.

According to one aspect of the invention, there is provided an inflatable enclosure for amusement purposes and/or promoting physical activity comprising:

inflatable means forming a chamber when inflated, preferably having an interior, exterior, wall, floor and ceiling;

blower means for supplying air at a predetermined rate and at a predetermined pressure to inflate said inflatable means, to form a chamber as clearly depicted and described in my U.S. Pat. No. 5,603,185 wholly incorporated by reference;

the inflatable enclosure further comprises a first entrance/exit preferably the entrance/exit is preferably made of a double door, the chamber can be of various forms. For example, tunnel-like, serpent-like, animal-like, mazes, obstacle courses or the like.

In another embodiment, said entrance/exit means further comprises an inflatable (air actuated) first entrance/exit means, preferably comprising at least two inflatable panels adjacent each other and arched substantially laterally towards each other, such that when the inflatable panels are opened to allow entrance into or exit out from the inflatable enclosure, a minimal loss of air is experienced.

In yet another embodiment there is provided an air pressure regulator to prevent substantial deflation of the inflatable enclosure when said entrance/exit is open.

In a preferred embodiment, said air pressure regulator is a second entrance/exit situated between said first entrance/exit and said chamber. Preferably said second entrance/exit is air actuated. Said second entrance/exit preferably comprising at least two inflatable panels adjacent each other and arched substantially laterally towards each other, such that when the inflatable panels are opened to allow entrance into or exit out from the inflatable enclosure, a minimal loss of air is experienced.

The combination of a first entrance/exit and an air pressure regulator, preferably a second entrance/exit substantially minimizes the loss of air pressure in the chamber when a person is entering/exiting the inflatable enclosure.

This is accomplished by having at least one of the first entrance/exit or the second entrance/exit closed when the other entrance/exit is open. The closed first or second entrance/exit when the other entrance/exit is open allows for the air pressure in the chamber to be regulated thus minimizing any substantial air pressure loss resulting in deflation of the chamber. When there is a first and second entrance/exit, there is found an antechamber between said first and said second entrance/exit. In this embodiment, if required, there is provided a rigidifying means to assist in substantially maintaining the shape of the antechamber when one of said first or second entrance is open. Said rigidifying means also aids in substantially maintaining the shape of the antechamber when both first and second entrances/exits are open.

In yet still another embodiment, the inflatable enclosure further comprises at least one substantially transparent portion.

Yet still in another embodiment, the inflatable enclosure comprises blower aperture means disposed on the inflatable means at a predetermined position for the connection of the blower means to the inflatable means.

In yet another embodiment, the chamber is further comprised of a plurality of interconnected panels and a least one floor panel and one ceiling panel, said panels being made of a substantially nylon-type material or the like.

In yet another embodiment, the inflatable enclosure further comprises restraining means to minimize movement of the enclosure, said restraining means preferably is integral with the inflatable means.

In yet still another embodiment, there is provided an inflatable enclosure for amusement purposes and promoting physical activity comprising: inflatable means being formed of a plurality of interconnected panels of an inflatable material, preferably taking the form of a chamber, when inflated, said chamber having, an interior, exterior, side walls, a floor, and a ceiling, whereon at least on one panel thereof, there is a window of transparent material; blower means for supplying air at a predetermined rate and pressure to said inflatable means; blower aperture means disposed on one of said interconnected panels forming one of said side wall, to allow said blower means to be in contact with said inflatable means; at least one vent means located on at least one of said panels forming the side walls to provide venting of said air in said tunnel-like chamber at a predetermined rate not causing substantial underinflation and/or overinflation; a first inflatable (air actuated) entrance/exit means disposed on said tunnel-like chamber, to allow entering into and exiting out of said chamber when inflated while maintaining said chamber inflated, an air pressure regulator, and preferably restraint means to minimize unwanted movement of said inflatable means when inflated.

In yet another embodiment, there is provided for use in amusing and promoting physical activity in children, an inflatable enclosure comprising: inflatable means forming a chamber having an interior, an exterior, a wall, a floor, and a ceiling, when inflated, said chamber when inflated being of a size suitable for allowing at least one person, preferably a child to walk, crawl, play or run around said interior thereof; blower means for supplying air at a predetermined rate and at a predetermined pressure to inflate the inflatable means, to form a chamber; the blower means being connected to said inflatable means; blower aperture means allowing for the connection of said blower means to said inflatable means, the blower aperture means being located on the inflatable means at a predetermined position; at least one vent means situated at a predetermined position on the inflatable means, to provide venting of said air within the interior of said chamber at a predetermined rate; inflatable (air actuated) entrance/exit means located at a predetermined position on said wall of the tunnel-like chamber of the inflatable means, and preferably a second inflatable (air actuated) entrance/exit means.

According to yet another embodiment there is provided a method of amusing and promoting physical activity in children, comprising placing children into an inflatable enclosure described herein.

Preferably, each of said first and second inflatable (air actuated) entrance/exit means further comprise at least two inflatable panels adjacent to each other and substantially self sealing, such that when the inflatable panels are opened to allow entrance into or exit out of the inflatable enclosure, a minimal loss of air is permitted.

In another embodiment, the chamber has a substantially circular cross-section.

Preferably, the chamber is comprised of a plurality of interconnected panels and a least one floor panel and one ceiling panel, the panels being made of a substantially nylon-type material or the like made of a substantially nylon-type material or the like. Preferably, the inflatable means is formed of a nylon-type material.

Preferably, the chamber has a substantially circular cross-section and preferably, the chamber is made of a fire retarding material. Preferably, the material used further comprises ultra-violet inhibitors. Preferably, the material used further comprises a water retarding material.

Preferably, the inflatable means further comprises restraining means to minimize movement of the inflatable enclosure, preferably, the restraining means are integral with the inflatable means.

According to yet another aspect of the invention, there is provided a method of amusing and promoting physical activity in children, said method comprising the use of an inflatable enclosure for amusement purposes comprising: inflatable means forming in one instance a tunnel-like or maze-like chamber having an interior, an exterior, a wall, a floor, and a ceiling, when inflated, said tunnel-like or maze-like chamber when inflated being of a size suitable for allowing at least one child to jump, crawl, walk or run around said interior thereof, blower means for supplying air at a predetermined rate and at a predetermined pressure to inflate the inflatable means, to form a tunnel-like or maze-like chamber, the blower means being connected to said inflatable means, blower aperture means allowing for the connection of the blower means to the inflatable means, the blower aperture means being located on the inflatable means at a predetermined position, inflatable (air actuated) entrance/exit means located at a predetermined position on the wall of the tunnel-like or maze-like chamber of the inflatable means, air pressure regulator, such that when the children enter the inflatable enclosure, when inflated, they can amuse themselves by running through the tunnel-like or maze-like chamber and hence engaging in physical activity, and the air pressure regulator maintains the shape of the chamber.

In any of the above mentioned embodiments, the air actuated (air inflatable) entrance/exit means (area) is preferably substantially self-sealing and the panels are preferably arched substantially laterally towards each other.

In another embodiment, there is provided an inflatable enclosure comprising:

at least one inflating means for inflating said inflatable enclosure;

at least one entrance/exit means for entering and exiting said inflatable enclosure;

at least one air pressure regulator for maintaining the air pressure in said enclosure when said at least one entrance/exit means is in use;

wherein at least one of said entrance/exit means and air pressure regulator is air actuated.

Preferably in one embodiment the entrance/ exit means is air actuated.

In another embodiment the air pressure regulator is air actuated.

In yet another preferred embodiment both entrance/exit means and air pressure regulator are air actuated.

In one embodiment the air pressure regulator is selected from a group consisting of:

an air pressure monitor and regulator;

a flap;

a substantially solid door;

an actuated air (inflatable) door.

Preferably the entrance/exit means and the air pressure regulator are situated at a predetermined distance from one another, preferably forming an antechamber to the inflatable enclosure. Preferably the antechamber further comprises an inflatable rigidifying means, preferably an inflatable archway, and preferably additionally an inflatable section connected to said inflatable archway to substantially maintain the shape of the antechamber when the entrance/exit means is open.

Preferably the inflatable archway is secured to the ground, preferably by way of stabilizing means. Preferably the inflatable archway is inflated by an air feed, preferably separate from the inflatable enclosure.

In yet another embodiment there is provided an inflatable enclosure comprising:

inflating means for inflating said inflatable enclosure;

entrance/exit means for entering and exiting said inflatable enclosure;

an air pressure regulating means for maintaining the air pressure in said enclosure when said entrance/exit means is in use; and substantially collapsible rigidifying means for substantially maintaining the shape of the inflatable enclosure when a person is entering or exiting the inflatable enclosure;

wherein at least one of said entrance/exit means and air pressure regulating means is air actuated.

Preferably the air pressure regulating means is an air actuated (inflatable) entrance.

Preferably an antechamber is located between the entrance/exit means and the air actuated (inflatable) entrance.

Preferably the substantially collapsible rigidifying means is proximate the antechamber, preferably extending from the entrance/exit means to the air pressure regulating means.

Preferably the inflatable enclosure further comprises a rigidifying support, preferably substantially collapsible, extending from the substantially collapsible rigidifying means to the air pressure regulating means.

In yet another embodiment there is provided an inflatable enclosure comprising:

at least one inflating means for inflating said inflatable enclosure a first entrance for entering said inflatable enclosure a second entrance proximate said first entrance for entering said inflatable enclosure;

wherein each of said first and second entrance aids in maintaining the inflatable enclosure substantially inflatable when entering the inflatable enclosure.

Preferably the inflatable enclosure further comprises an antechamber between said first and second entrance.

Preferably the inflatable enclosure further comprises a rigidifying means proximate said antechamber. Preferably said rigidifying means is substantially inflatable.

Preferably the inflatable enclosure further comprises a rigidifying support connecting said rigidifying means to said second entrance.

BRIEF DESCRIPTION OF DRAWINGS

The following figures illustrate preferred and alternative embodiments of the invention, wherein.

DESCRIPTION OF A PREFERRED EMBODIMENT OF THE INVENTION

Figure 1:
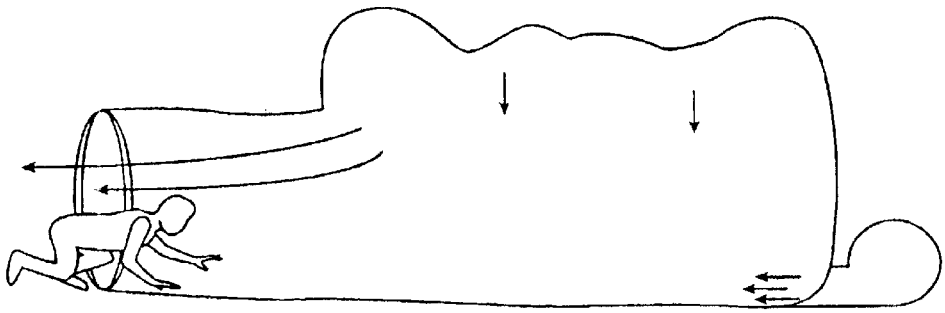
Figure 1 Prior Art
FIG. 1 is a side view of a prior art inflatable enclosure.

Referring now to the figures, FIG. 1 depicts a typical prior art inflatable enclosure which has a single entrance without an air pressure regulator. As can be clearly seen in the prior art while a person is entering the inflatable enclosure the air pressure is reduced thus resulting in substantial deflation of the inflatable enclosure. Some of the drawbacks associated with the prior art include a sense of uneasiness in the participant as well as an observer if the unit begins to deflate while in use, a possibility of unsafe conditions which may cause panic with the participant as well as an observer during partial deflation. Other drawbacks will become apparent to a person skilled in the art having knowledge of the prior art systems.

Figure 2:
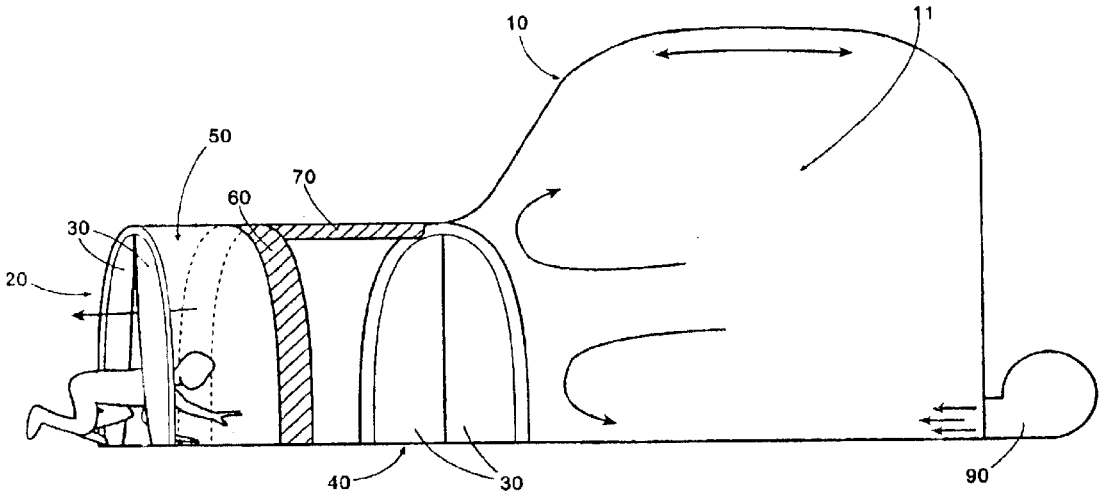
FIG. 2 is a side view of an inflatable enclosure according to a preferred embodiment of the present invention, when a participant has opened the first entrance.
Figure 3:
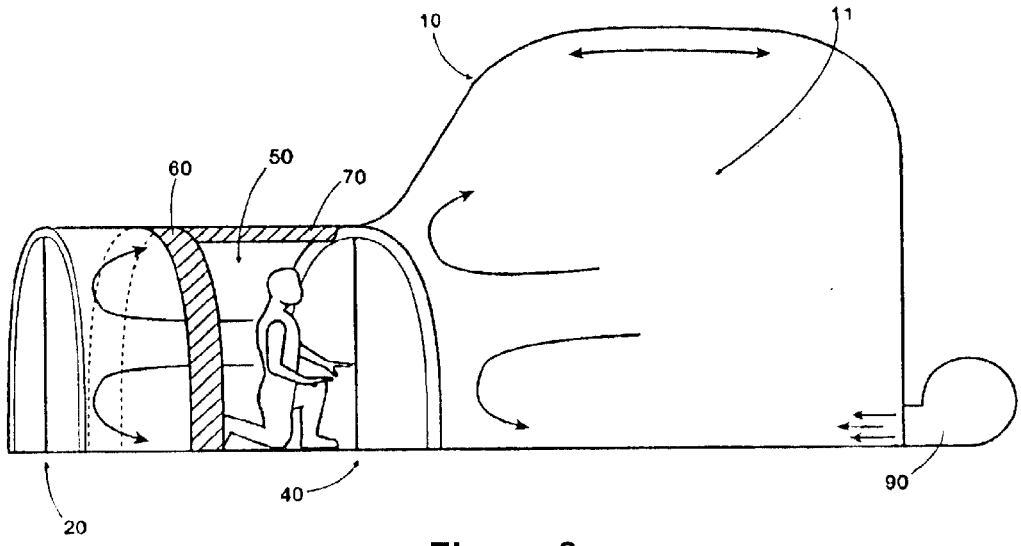
FIG. 3 is a side view of the inflatable enclosure as shown in FIG. 2, when the participant is in the antechamber and the first entrance is closed.

Referring now to FIGS. 2, 3, 4 and 5, there is provided a sequence where a participant is entering a preferred embodiment of the present invention. FIG. 2 provides for the participant entering the inflatable enclosure 10 by first opening the first entrance 20 which consists of two inflatable panels 30 that when inflated are urged towards each other providing a sufficient seal between the two panels 30. A further description of the first entrance can be found in FIGS. 6, 7 and 8. When the participant is entering the inflatable enclosure 10 and is at the first entrance 20 as can be seen in the figures, the second entrance 40 remains substantially sealed wherein the second entrance 40 is substantially of the same configuration as the first entrance 20. The second entrance 40 remaining substantially sealed allows for the regulation of the air pressure in the inflatable enclosure 10 when the participant is opening the first entrance 20 to enter the inflatable enclosure 10. As can be seen in FIG. 3, the participant is now in the antechamber 50 which is formed between the first entrance 20 and second entrance 40. In this instance both the first entrance 20 and second entrance 40 are substantially sealed and once again the pressure is maintained through the inflatable enclosure 10. As can be seen in FIG. 3, there is also provided a rigidifying means which is in the shape of an inflatable archway 60 in this embodiment and assists in maintaining the shape of the antechamber 50 located between the first 20 and second 40 entrances. Although the rigidifying means is depicted here as an inflatable archway 60, it may be of a configuration which is substantially rigidifies and provides support in maintaining the shape of the antechamber 50 and the first 20 entrance. In this embodiment the inflatable archway 60 is proximate said first entrance 20 thereby when the participant enters the inflatable enclosure 10 and is in the process of opening the first entrance 20, the inflatable archway 60 aids in maintaining the shape of the antechamber 50 since the antechamber 50 will experience a reduction in air pressure by the participant when opening said first entrance 20. As can be seen in the FIG. 3, the inflatable archway 60 further comprises a rigidifying support which extends substantially normal from said inflatable archway 60 towards said second entrance 40 proximate the top of said second entrance 40. This once again provides for further support in maintaining the shape of the antechamber 50 and the second entrance 40 when a participant is entering the inflatable enclosure 10 and is opening said first entrance 20.

As explained above, when said first entrance 20 is open, the antechamber 50 experiences a reduction in air pressure and thus the rigidifying support further enhances the shape maintenance of the antechamber 50 when the first entrance 20 is in the open position.

Figure 4:
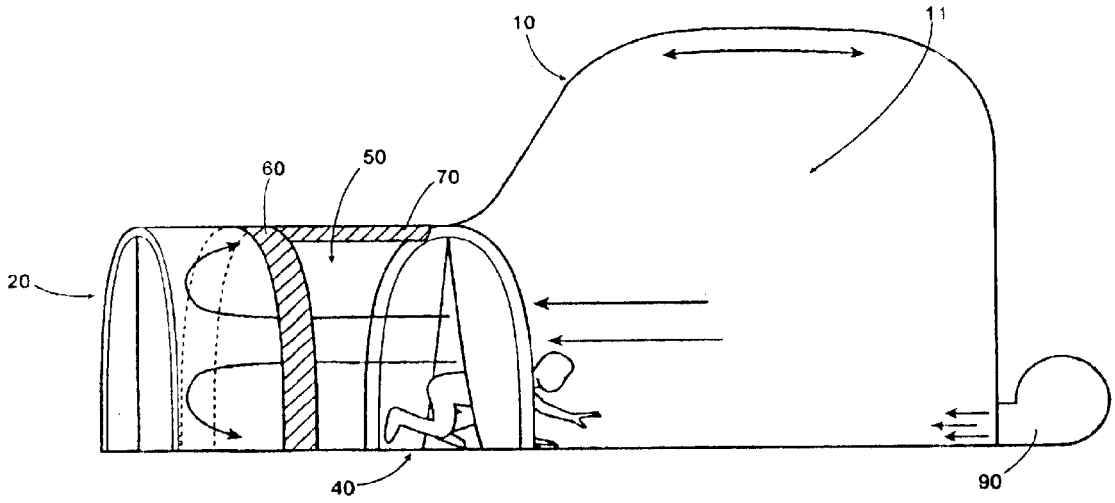
FIG. 4 is a side view of the inflatable enclosure as shown in FIG. 2, when the participant has opened the second entrance and is entering the chamber.

As can be seen in FIG. 4, the participant when opening said second entrance 40 to enter into the chamber 11, it can be clearly seen that the inflatable enclosure 10 maintains the air pressure within since the first entrance 20 provides a substantial seal preventing unwanted air pressure loss when the second entrance 40 is in the open position.

Figure 5:
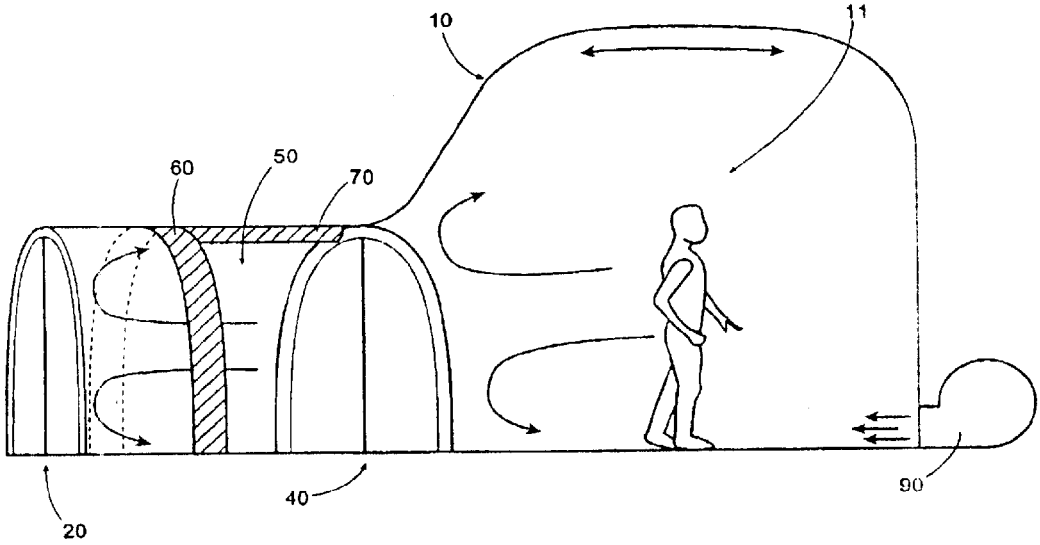
FIG. 5 is a side view of the inflatable enclosure as shown in FIG. 2, when the participant is in the chamber and the second entrance is closed again.

Referring now to FIG. 5, the participant is now in the chamber 11 portion of the inflatable enclosure 10 and both the first 20 and second 40 entrances are now substantially sealed and the air pressure is once again maintained and regulated by the substantially self sealing first 20 and second 40 entrance. Similarly although not shown in the drawings should the participant decide to exit the inflatable enclosure 10 through said first 20 and second 40 entrance/exit means, the air pressure within the inflatable enclosure 10 will be maintained since at all times in this instance as indicated above, at least one of said first 20 or said second 40 entrance/exit will be substantially sealed when the other of said at least one of said first 20 or said second 40 entrance is substantially open. A further benefit of the current invention is that should both said first 20 and said second 40 entrance be open at the same time, the inflatable archway 60 together with the rigidifying support will aid in maintaining the shape of said antechamber 50 should there be more than one participant in said antechamber 50 at the same time although in the figures said air pressure regulator is depicted above as an actuated first 20 or second 40 entrance other systems or devices may be used to regulate the air pressure.

Figure 6:
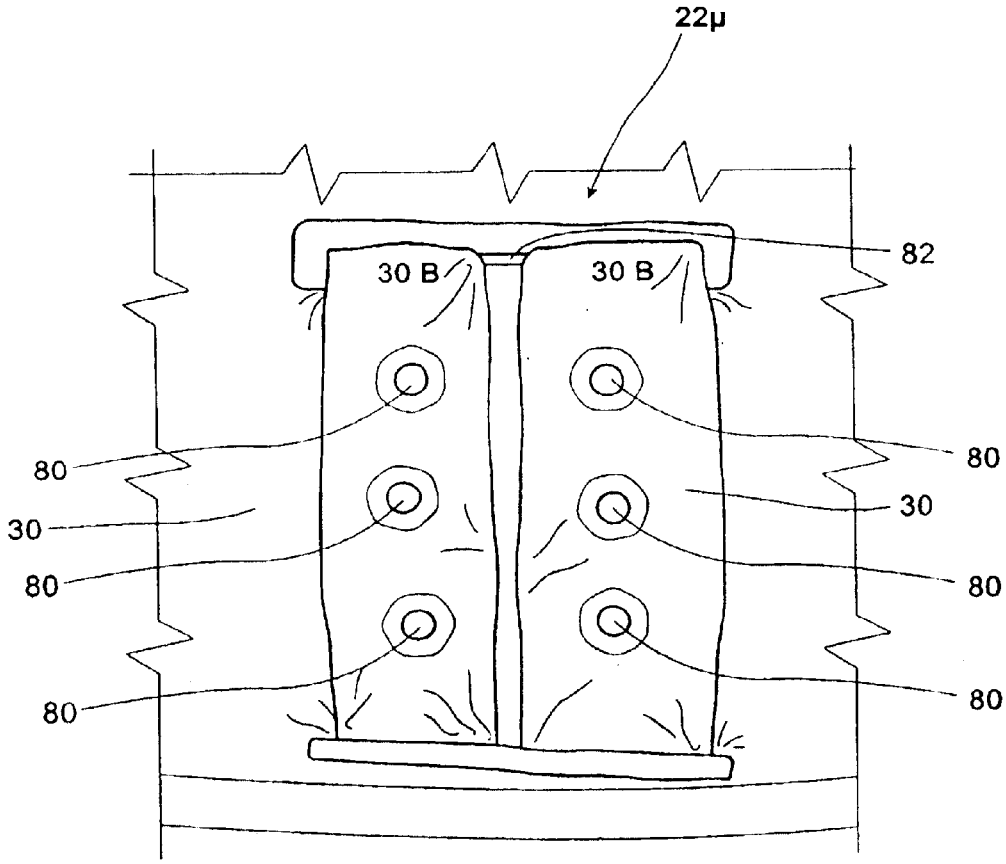
FIG. 6 is an interior view of the entrance/exit in a preferred embodiment of the present invention.
Figure 7:
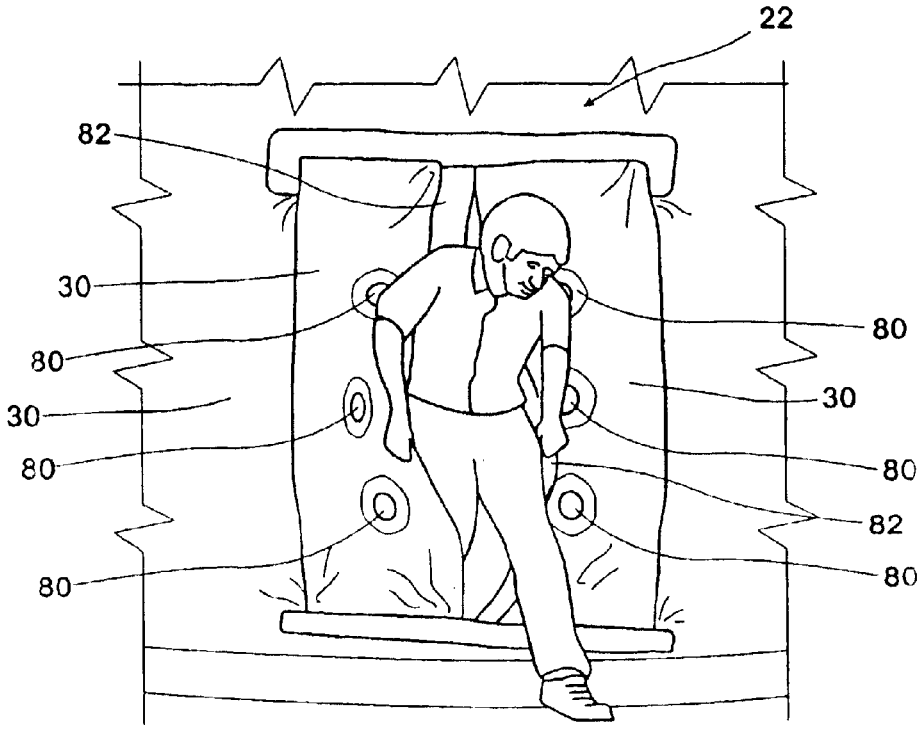
FIG. 7 is an interior view of the entrance/exit as shown in FIG. 6 showing a person passing through the entrance/exit of the present invention.
Figure 8:
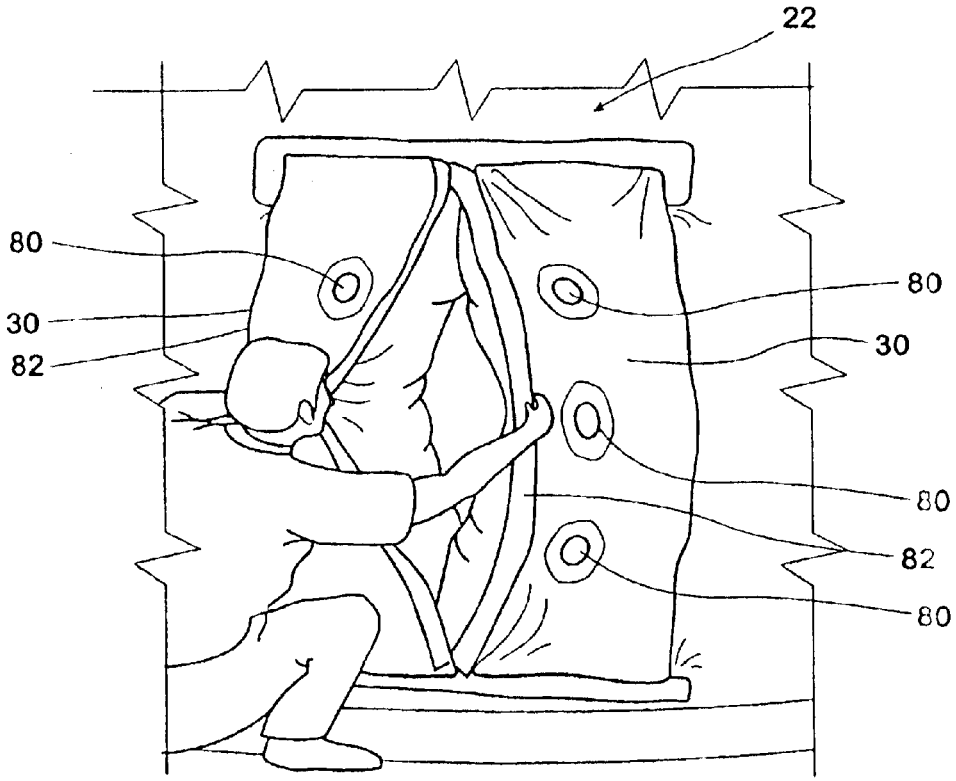
FIG. 8 is an interior view of a person preparing to exit through the entrance/exit of the present invention.

As can be seen in FIGS. 6, 7 and 8 in the preferred embodiment, the structure of the first entrance and second entrance is depicted.

Referring now to FIGS. 6, 7 and 8 a view of the air actuated inflatable entrance/exit 22 from the interior of the inflatable enclosure 10 shows a plurality of air apertures 80 on each inflatable panel respectively to allow the air from the blower to enter/exit the inflatable panels 30 forming the air actuated entrance/exit. Therefore each panel 30 has a pair of spaced sheets 30A and 30B connected to form an inflatable envelope at their periphery to provide a space there between into which air enters through apertures 80 formed through sheets 30B which when expanded cause the edges of the inflated panels 30 to move toward each other.

The inflatable panels 30 have on the interior as well flaps 82 to further seal the air from escaping the enclosure 10. These flaps 82 together with the inflatable panels 30 are laterally urged against each other due to air pressure from the blower 90, and provide a self-sealing action to prevent unwanted substantial air loss at the enclosure 10.

Figure 9:
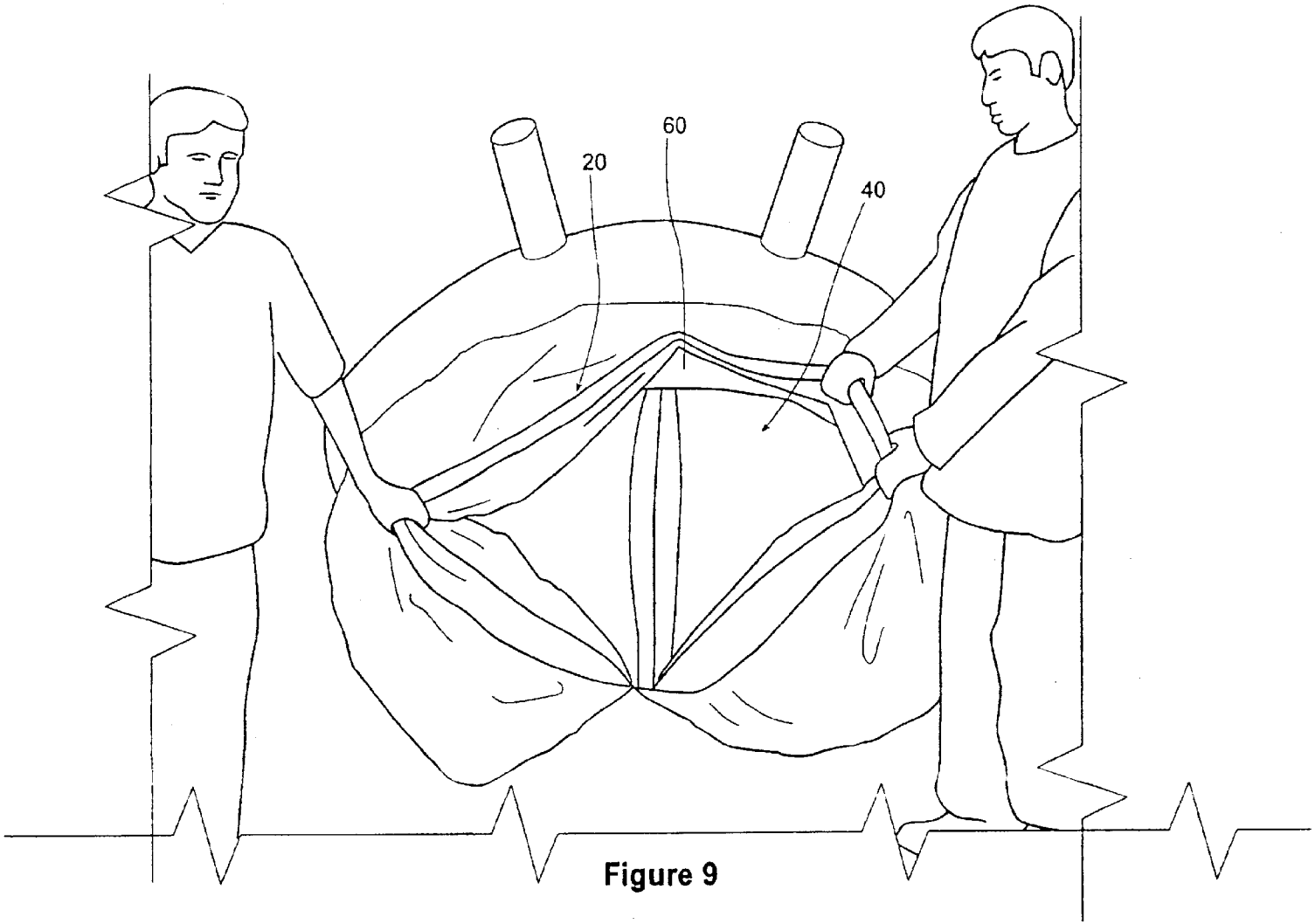
FIG. 9 is a front view of a double entrance according to a preferred embodiment of the present invention with the first entrance being held open to permit viewing of the second entrance.

Referring now to FIG. 9, there is provided a front view of the inflatable enclosure 10 where the first entrance 20 is opened as can be clearly seen when the first entrance 20 is opened, the second entrance 40 remains substantially sealed and the rigidifying means depicted as an inflated archway 60 maintain the shape of the opening of the first entrance 20 when said first entrance 20 is opened allowing a participant to enter through to the antechamber 50 without experiencing any substantial air pressure loss.

Figure 10:
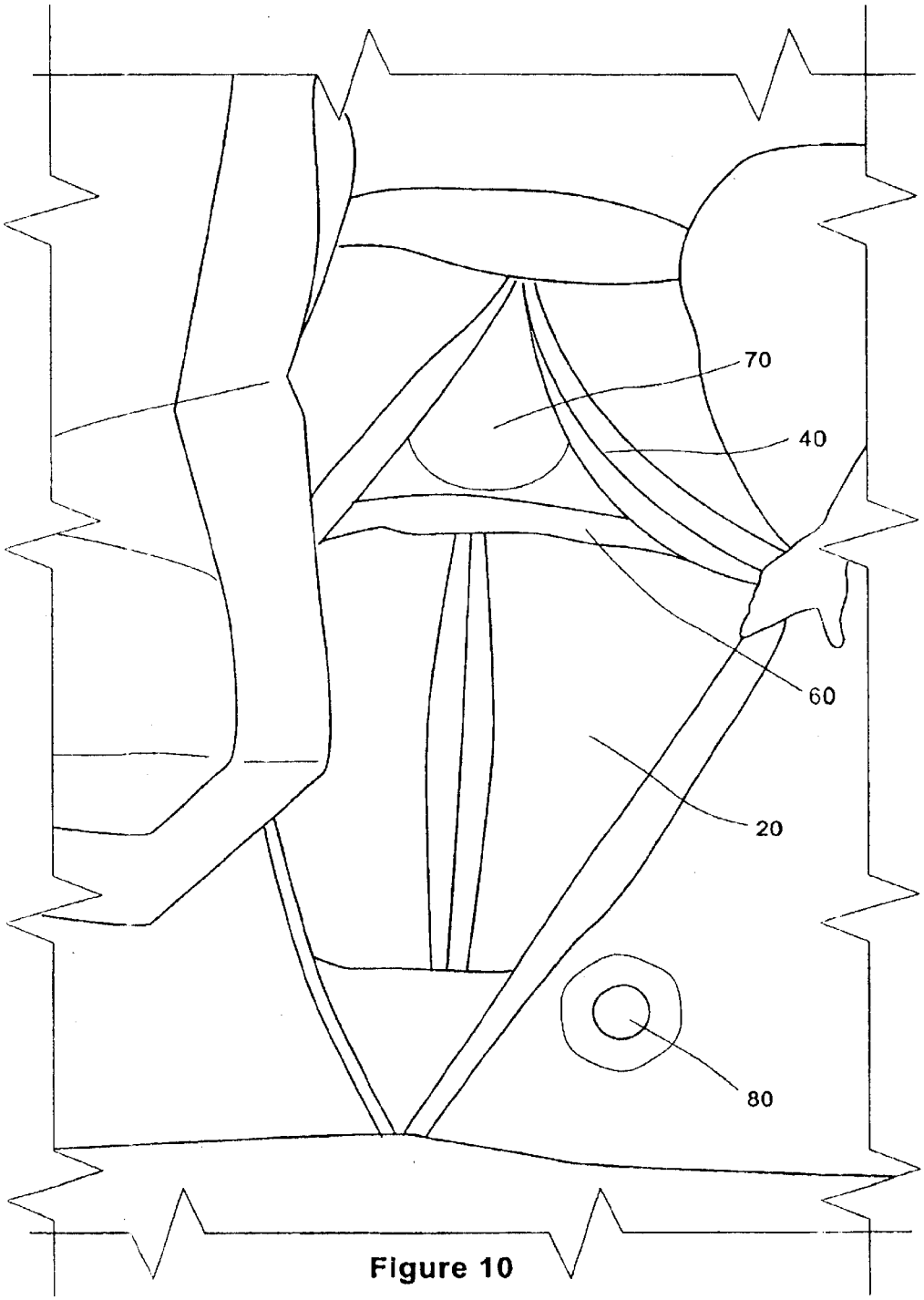
FIG. 10 is an interior view of the double entrance as shown in FIG. 9 with the second entrance being held open to permit the viewing of the antechamber and the first entrance.
Figure 13:
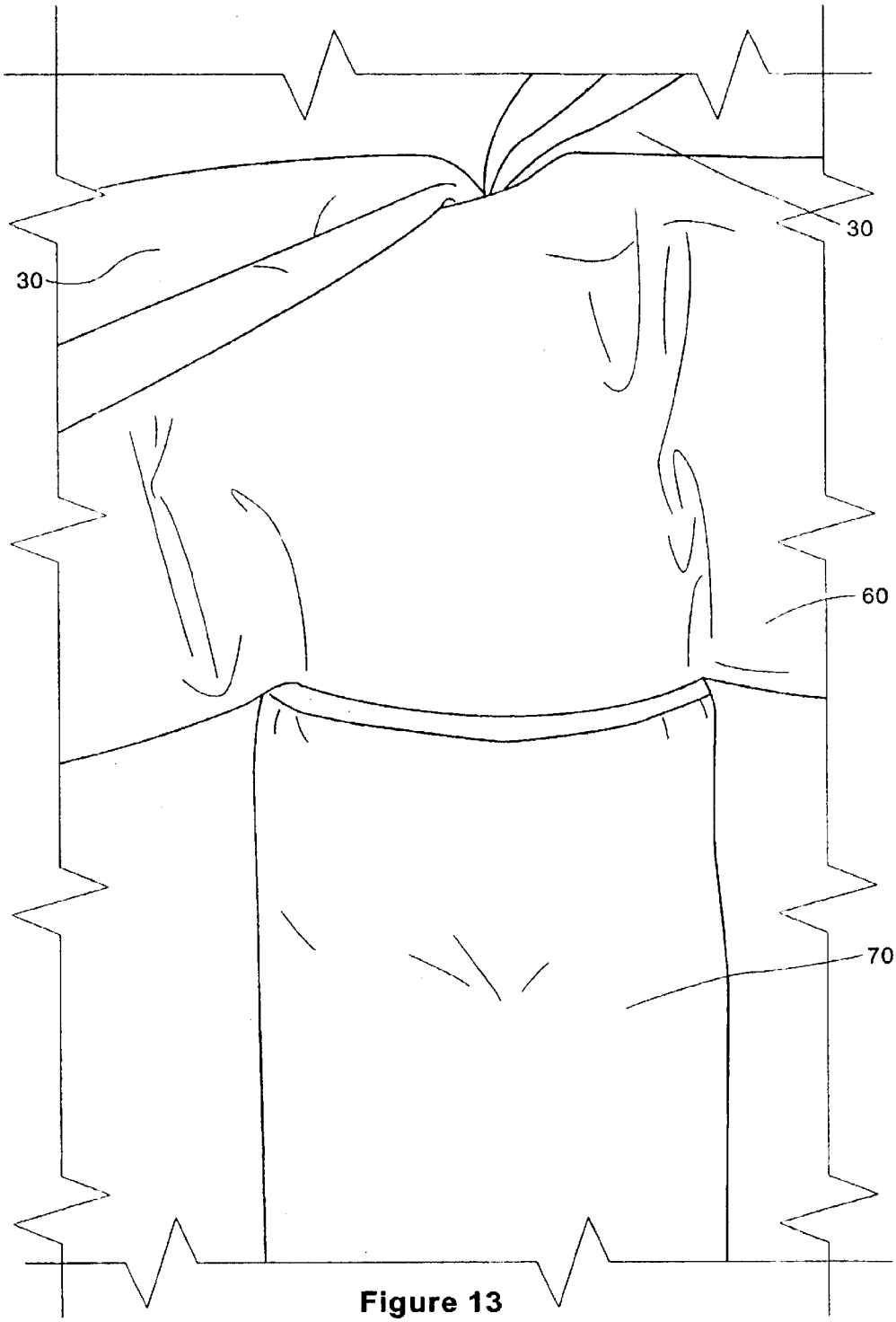
FIG. 13 is an underneath view of the ceiling of the antechamber found between the first and second entrance/exit of a preferred embodiment of the present invention.

Referring now to FIG. 10, there is shown a second entrance 40 being opened with the first entrance 20 remaining substantially sealed once again allowing for the inflatable enclosure 10 to remain substantially inflated and not experience any substantial air pressure loss. As can be seen in the antechamber 50, there is found the inflatable archway 60 and extending substantially normal from said inflatable archway 60 along the top of the antechamber 50 is the rigidifying support said rigidifying supports as can also be found in FIG. 13 extends from the inflatable archway 60 substantially normal thereto and in this instance the rigidifying support is an inflatable rigidifying section 70 which is inflated by the same inflating means (not shown in the drawings) such as blower 90 that inflates the inflatable archway 60.

Figure 11:
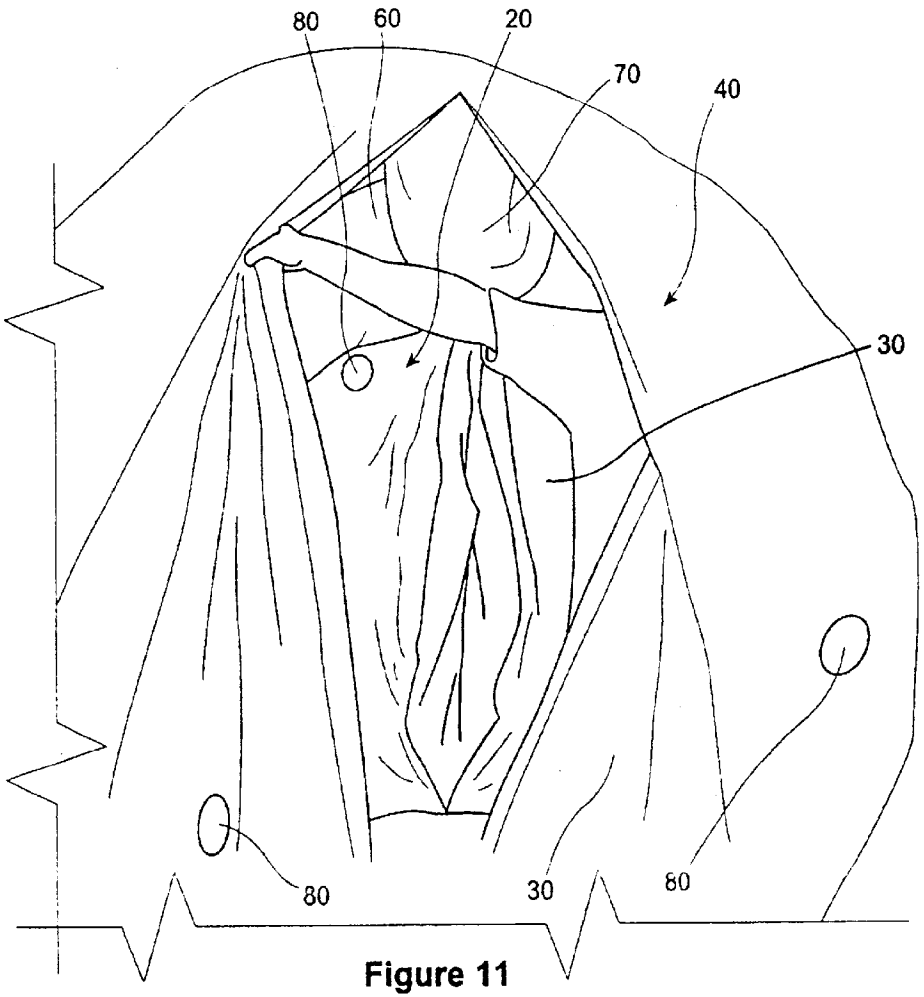
FIG. 11 is an interior view of the double entrance with the second entrance held open to permit the viewing of the antechamber and the first entrance which is closed.

As can be seen in FIGS. 10 and 11, the first 20 and second 40 entrances and the panels 30 thereof are provided with a plurality of air apertures 80, again previously depicted in FIGS. 6, 7 and 8 to allow the air from the blower 90 to enter and exit the inflatable panels 30 forming the air actuated inflatable entrance/exit 22.

Figure 12:
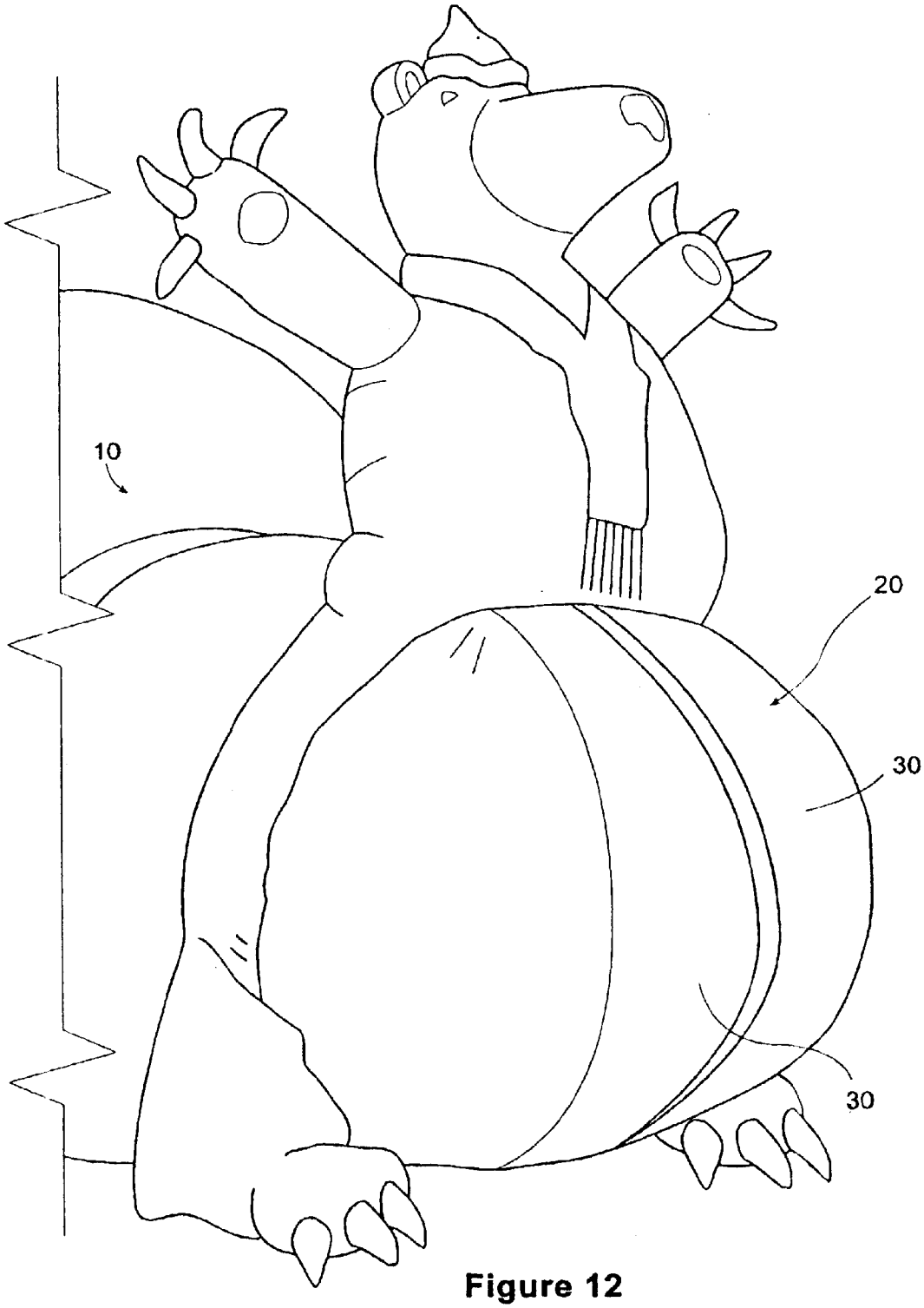
FIG. 12 is a perspective view of the first entrance of the inflatable enclosure according to a preferred embodiment of the present invention.
Figure 14:
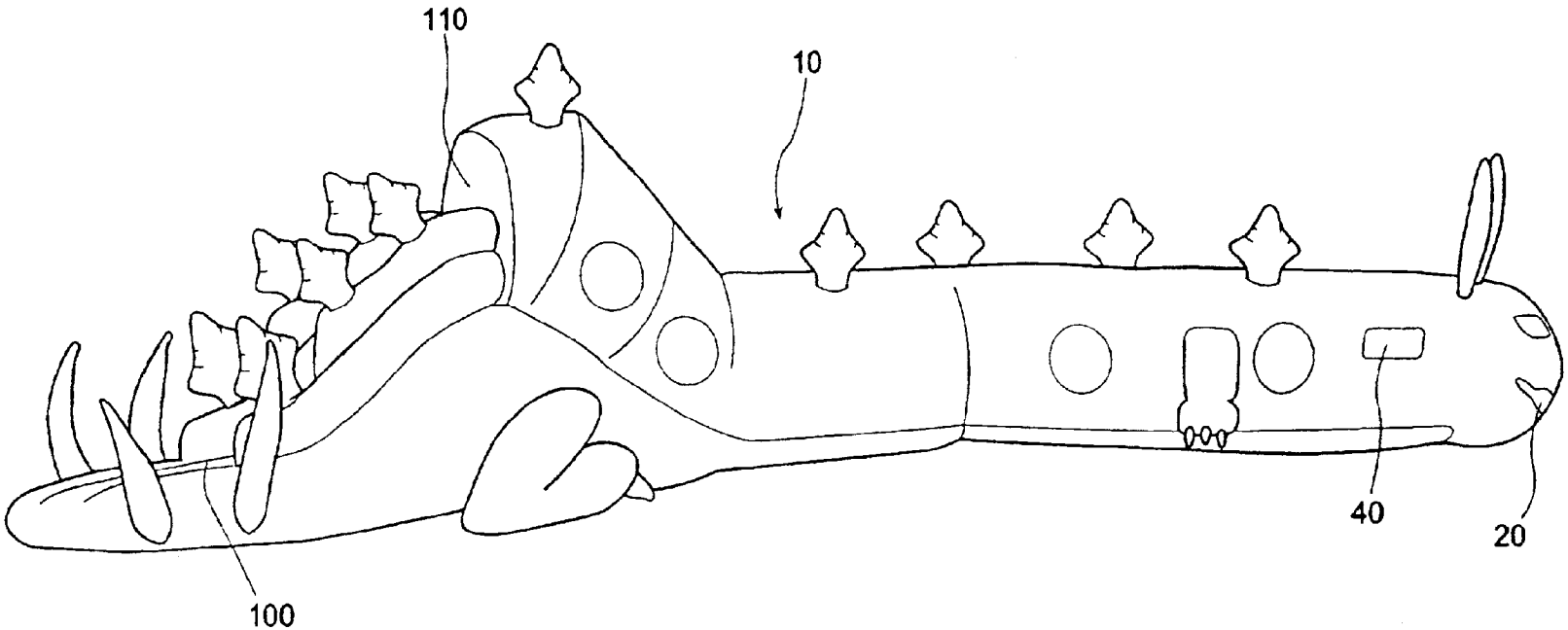
FIG. 14 is a perspective view of an inflatable enclosure comprising a double entrance according to a preferred embodiment of the present invention.
Figure 15:
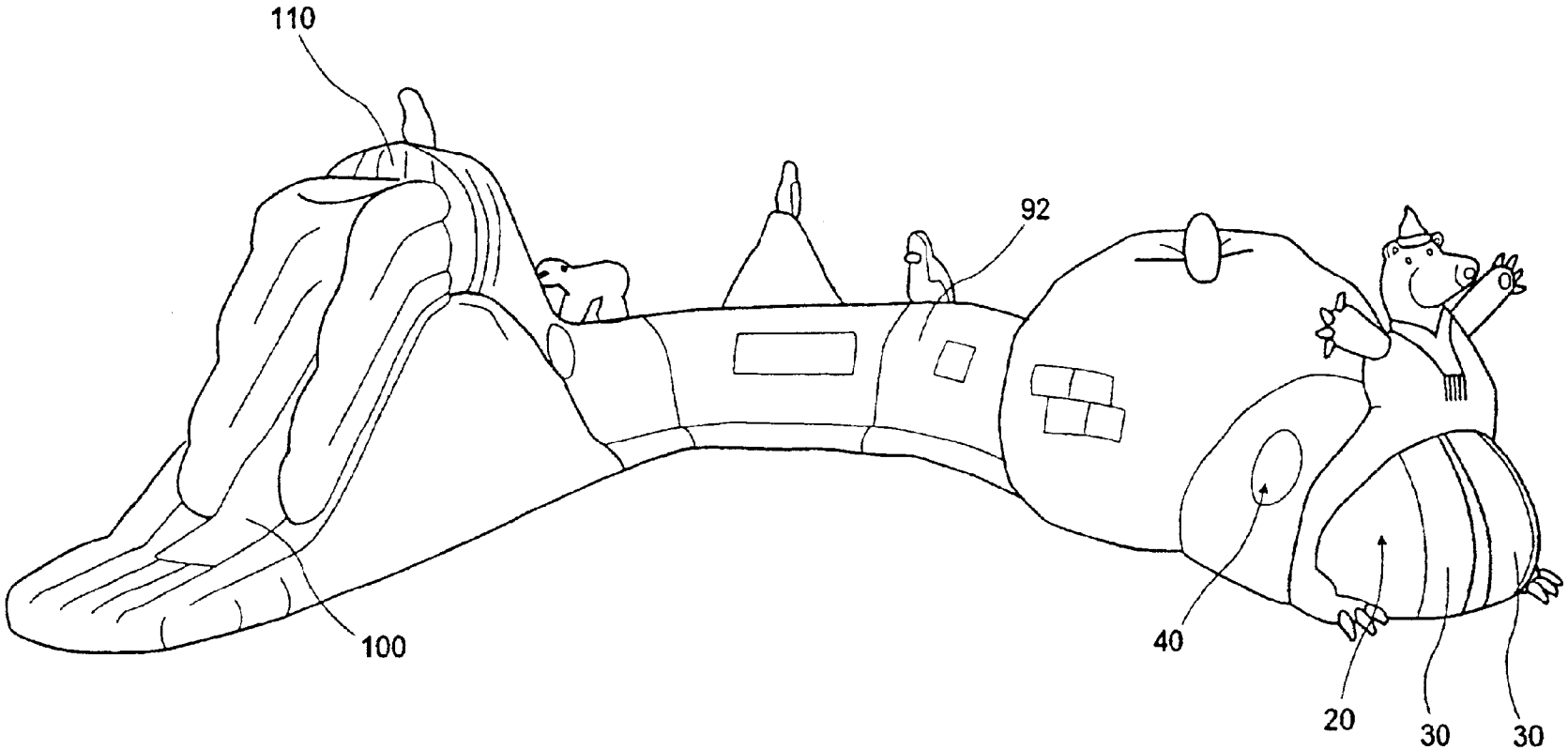
FIG. 15 is a perspective view of another inflatable enclosure comprising a double entrance according to a preferred embodiment of the present invention.
Figure 16:
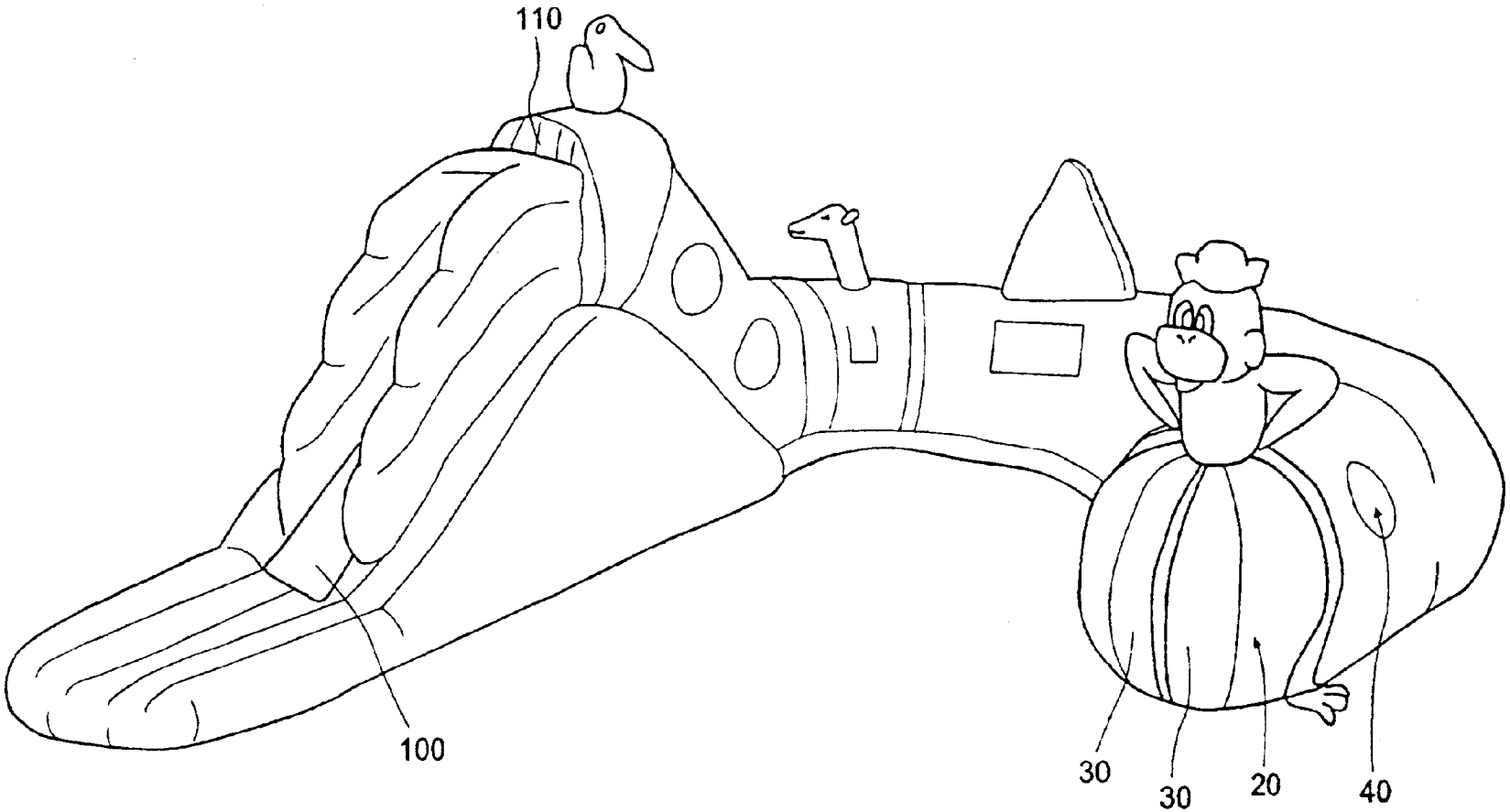
FIG. 16 is a perspective view of yet another inflatable enclosure comprising a double entrance according to a preferred embodiment of the present invention.
Figure 17:
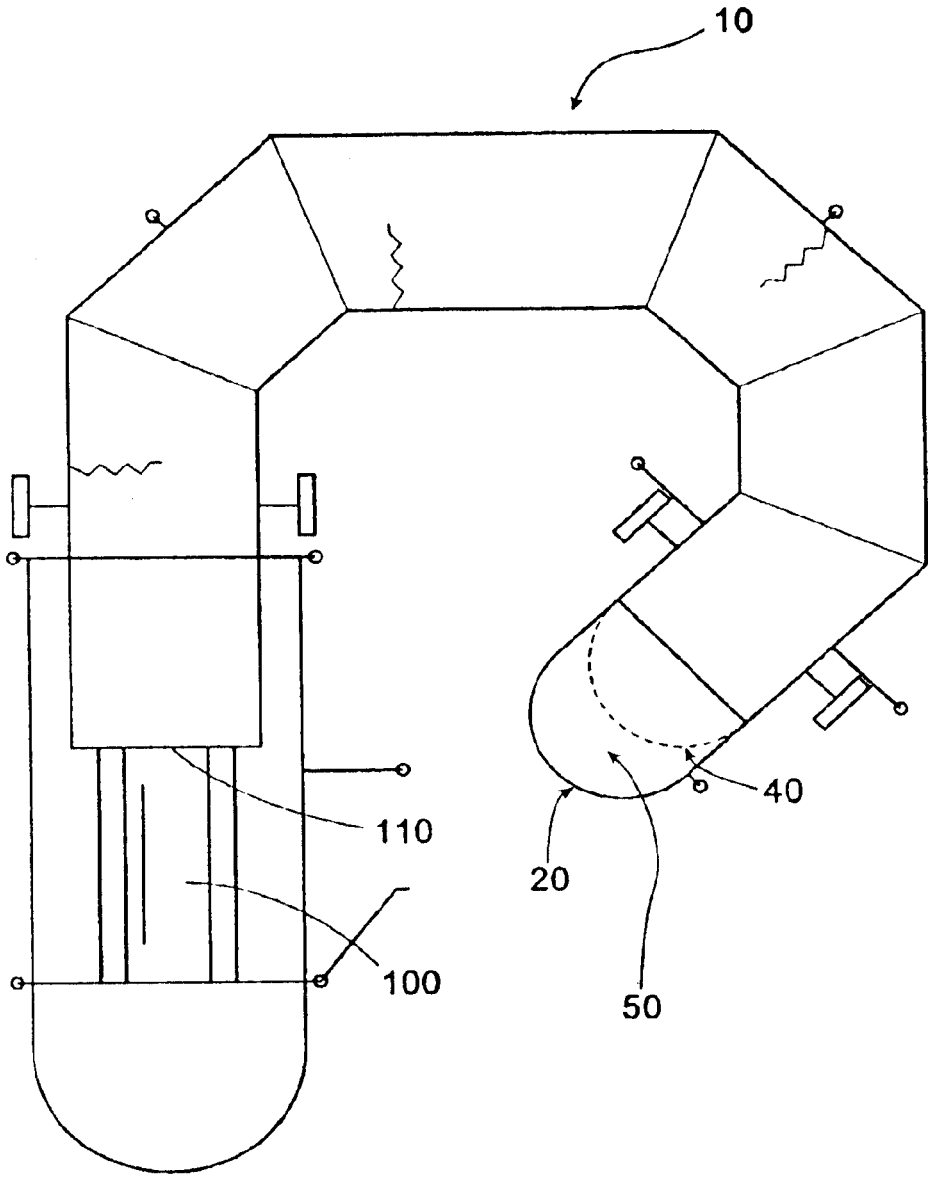
FIG. 17 is a top schematic view of an inflatable enclosure as shown in FIG. 16.

As can be seen in FIG. 12 as well, there is a perspective of the one embodiment of an inflatable enclosure 10 showing the first entrance 20. The inflatable enclosure 10 incorporating the invention may take the shape of many forms including a maze, a tunnel-like form and the like. For example, as found in FIG. 14, there is shown a dinosaur shape inflatable enclosure 10 which includes distant the first 20 and second 40 entrance means, a separate exit 110 which may be an air actuated inflatable entrance 22 such as described in FIGS. 6, 7 and 8 and there may be added a slide 100 which enhances the enjoyment and amusement to the participant. FIG. 15 shows the full view of the inflatable enclosure 10 as depicted in FIG. 12 which provides for an igloo and then a tunnel 92 and again a separate exit 110 and a slide 100. FIG. 16 provides an inflatable enclosure 10 that Applicant has called Gorilligan's Island™ which incorporates the present invention as well as a separate exit 110 and a slide 100. FIG. 17 is a top schematic view of the inflatable enclosure depicted in FIG. 16.

While the foregoing provides a detailed description of preferred embodiments of the invention, it is to be understood that this description is illustrative only of the principles of the invention and not limitative. Furthermore, as many changes can be made to the invention without departing from the scope of the invention is intended that all material contained herein be interpreted as illustrative of the invention and not in a limiting sense.

A preferred embodiment of the present invention is a lightweight inflatable walk-through attraction containing inflated obstacles. A small slide, in one instance approximately 6 feet high and preferably angled approximately 30° to the horizontal, is located at the exit of the attraction, outside the body.

Patrons enter at the mouth of the attraction and walk through to the exit at the tail.

Preferably there are numerous windows and vent holes to permit the operator and other adults to supervise the activities of the children inside. Communication with the occupants can be through the vent holes or simply through the fabric itself.

Preferably, in addition to the main entrance and exit, there are emergency exits consisting of zippered openings placed at the centre on either side so that no patron is more than 3 meters from any exit.

The attraction is supported by air pressure, however preferably a set of plastic hoops may be supplied and placed at 3 meter intervals to afford some support in the event of deflation.

Preferably, the attraction is anchored at the points shown additionally, and preferably when hoops are used their bases are fixed down to provide further restraint.

The anchors, may preferably be ⅝" bar candy-cane shape, and are to be inserted at least 16" into firm ground. Alternatively, sandbags each may be used, preferably sandbags weighing 50 lbs.

To set up the unit according to a preferred embodiment of the present invention, it should be set up on a suitable surface. It should not be secured down until it is inflated. One should connect the blowers to the air ducts and secure with the Velcro tape. The blower should be directly connected to the power supply. Inflate the unit, making sure the blower is on high setting and that all deflation vents are closed. The unit can now be secured, for example, staked down. The stakes should be driven into firm ground to a minimum depth of 16 inches. A grassed area will be sufficiently firm. Maximum wind speed for safe operation is 30 km/hr (20 mph).

To operate the preferred embodiment of the present invention at least one operator shall be on duty at all times the unit is being used. The maximum capacity of the unit is 6 persons. It is preferable, to group children by size and age, do not allow small children in at the same time as larger and more boisterous children. The wearing of shoes is not allowed. It is preferable to remove any hard or sharp objects, eg. Pens, buckles, jewelry, etc. It is also preferable to remove glasses. The unit should not be used when wet. It is preferable for the person using the unit to not have any gum or face paint. Children should not deliberately collide with each other. Waiting children should stand at least 3 feet (1 meter) from the front of the unit. In case of power failure the operator should assist the children out of the unit immediately using both main and emergency exits and do not allow them to re-enter until power is restored and the unit fully inflated. The operator should walk through the deflated attraction to ensure no child remains inside.

The unit can be easily cleaned with a cloth or light brush. Use a vinyl cleaner and rinse thoroughly to remove detergent before storing. Do not pack the unit away when wet. If this is unavoidable, lay the unit out to dry at the earliest opportunity.

The unit should be inspected regularly for damage. If there is evidence of tearing at the anchor points, the unit should not be used until repairs have been made.

The unit depicted as a preferred embodiment of the present invention and ones very similar to it have been inspected and tested several times. The tests have been limited to a stability check of the slide and deflation.

Deflation: the body of the attraction deflates quite quickly in one instance, around 1 minute. This time reduces if all emergency exits are opened. Once deflated, the structure is somewhat erect if the hoops are used and a fairly clear view along the interior can be had when fully deflated. One can readily walk through the attraction in this condition and no child can be concealed from an adult doing this. The walk-through can be done in less than 10 seconds.

While the foregoing provides a detailed description of a preferred embodiment of the invention, it is to be understood that this description is illustrative only of the principles of the invention and not limitative. Furthermore, as many changes can be made to the invention without departing from the scope of the invention, it is intended that all material contained herein by interpreted as illustrative of the invention and not in a limiting sense.

What is claimed is:

1. An inflatable enclosure comprising:

at least one inflating means for inflating said inflatable enclosure;

at least one entrance/exit means for entering and exiting said inflatable enclosure;

at least one air pressure regulator for maintaining the air pressure in said enclosure when said at least one entrance/exit means is in use, at least one inflatable rigidifying means for substantially maintaining the shape of the inflatable enclosure when a person is entering or exiting the inflatable enclosure; wherein at least one of said entrance/exit means and air pressure regulator is air actuated.

2. An inflatable enclosure according to claim 1, wherein the entrance/exit means is air actuated.

3. An inflatable enclosure according to claim 1, wherein the air pressure regulator is air actuated.

4. An inflatable enclosure according to claim 1, wherein both entrance/exit means and air pressure regulator are air actuated.

5. An inflatable enclosure according to any one of claims 1 to 4, wherein the air pressure regulator is selected from a group consisting of:

an air pressure monitor and regulator;

a flap;

a substantially solid door;

an air actuated door.

6. An inflatable enclosure according to claim 1, wherein the entrance/exit means and the air pressure regulator are situated at a predetermined distance from one another.

7. An inflatable enclosure according to claim 6, wherein the entrance/exit means and the air pressure regulator form part of an antechamber to the inflatable enclosure.

8. An inflatable enclosure according to claim 7, wherein the inflatable rigidifying means is proximate the antechamber.

9. An inflatable enclosure according to claim 7 or 8, wherein the antechamber further comprises a supplementary inflatable rigidifying support to substantially maintain the shape of the antechamber when the entrance/exit means is open.

10. An inflatable enclosure according to claim 9, wherein the inflatable rigidifying support is connected to the inflatable rigidifying means.

11. An inflatable enclosure according to claim 10, wherein the inflatable rigidifying means is secured to the ground.

12. An inflatable enclosure according to claim 11, wherein the inflatable rigidifying means is secured to the ground by way of stabilizing means.

13. An inflatable enclosure according to claim 12, wherein the inflatable rigidifying means is inflated by inflating means.

14. An inflatable enclosure of claim 13, wherein the inflating means is a secondary inflating means.

15. An inflatable enclosure according to claim 14, wherein said secondary inflating means is connected to the stabilizing means.

16. An inflatable enclosure comprising:

inflating means for inflating said inflatable enclosure;

entrance/exit means for entering said inflatable enclosure;

an air pressure regulating means for maintaining the air pressure in said enclosure when said entrance/exit means is in use;

substantially collapsible inflatable rigidifying means for substantially maintaining the shape of the inflatable enclosure when a person is entering or exiting the inflatable enclosure;

wherein at least one of said entrance/exit means and air pressure regulating means is air actuated.

17. An inflatable enclosure as claimed in claim 16, wherein the air pressure regulating means is an air actuated entrance/exit.

18. Inflatable enclosure as claimed in claim 17, further comprising an antechamber located between the entrance/exit means and the air actuated entrance/exit.

19. Inflatable enclosure as claimed in claim 18, wherein the substantially collapsible inflatable rigidifying means is proximate the antechamber.

20. Inflatable enclosure as claimed in claim 19, wherein the substantially collapsible inflatable rigidifying means extends substantially between the entrance/exit means to the air actuated entrance/exit.

21. Inflatable enclosure as claimed in claim 20, further comprising a rigidifying support extending from the substantially collapsible inflatable rigidifying means to the air actuated entrance/exit.

22. Inflatable enclosure as claimed in claim 21, wherein the rigidifying support is substantially collapsible.

23. An inflatable enclosure comprising:

at least one inflating means for inflating said inflatable enclosure a first entrance for entering said inflatable enclosure a second entrance proximate said first entrance for entering said inflatable enclosure, a supplementary rigidifying support situated between said inflatable archway and said second entrance, an inflatable archway proximate said first entrance;

wherein an each of said first and second entrance aids in maintaining the inflatable enclosure substantially inflated when entering the inflatable enclosure.

24. The inflatable enclosure of claim 23 further comprising an antechamber between said first and second entrance.

* * * * *